US007766089B2

(12) United States Patent
Murray

(10) Patent No.: US 7,766,089 B2
(45) Date of Patent: Aug. 3, 2010

(54) PACKER SYSTEM AND METHOD

(75) Inventor: Douglas J. Murray, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 269 days.

(21) Appl. No.: 11/686,999

(22) Filed: Mar. 16, 2007

(65) Prior Publication Data

US 2008/0223571 A1 Sep. 18, 2008

(51) Int. Cl.
*E21B 33/12* (2006.01)
*E21B 33/124* (2006.01)

(52) U.S. Cl. ..... 166/387; 166/118; 166/191

(58) Field of Classification Search ..... 166/387, 166/55, 101, 118, 191; 175/230
See application file for complete search history.

(56) References Cited

U.S. PATENT DOCUMENTS

| | | | | |
|---|---|---|---|---|
| 4,044,826 | A | 8/1977 | Crowe | |
| 4,176,715 | A | 12/1979 | Bigelow et al. | |
| 4,311,195 | A | 1/1982 | Mullins, II | |
| 4,519,456 | A | 5/1985 | Cochran | |
| 4,572,289 | A * | 2/1986 | Rosenthal | 166/123 |
| 4,903,777 | A | 2/1990 | Jordan, Jr. et al. | |
| 4,930,573 | A | 6/1990 | Lane et al. | |
| 4,949,793 | A | 8/1990 | Rubbo et al. | |
| 5,044,444 | A | 9/1991 | Coronado | |
| 5,058,673 | A * | 10/1991 | Muller et al. | 166/187 |
| 5,810,082 | A | 9/1998 | Jordan, Jr. | |
| 6,896,049 | B2 | 5/2005 | Moyes | |
| 2002/0121380 | A1 * | 9/2002 | Doane et al. | 166/382 |

FOREIGN PATENT DOCUMENTS

| | | |
|---|---|---|
| GB | 2 164 375 | 3/1986 |
| GB | 2 381 546 | 5/2003 |

OTHER PUBLICATIONS

International Search Report with Written Opinion, PCT/US2008/050257, Date Mailed, Apr. 23, 2008.
SAND79-7125, Program for the Improvement of Downhole Drilling-Motor Bearings and Seals, Sandia Laboratories,, Phase III, Part 2: Final Report, Terra Tek, Salt Lake City, Utah, Mar. 1980.
Horn, Mark, et al. "Otter: The World's Longest Subsea Tie-Back with Dual ESP," OTC 15369, Houston, Texas, May 5-8, 2003.
Kothari, Kiran M., et al. Sealing Large-Diameter Cast-Iron Pipe Joints Under Live Conditions, Final report, Gas Technology Institute, DE-FC22-02NT41316, Dec. 2005.

* cited by examiner

*Primary Examiner*—David J Bagnell
*Assistant Examiner*—Cathleen R Hutchins
(74) *Attorney, Agent, or Firm*—Cantor Colburn LLP

(57) ABSTRACT

Disclosed herein is a packer system. The packer system includes, a first packing element settable to create a seal against a downhole structure, and a contingency packing element in operable communication with the first packing element, maintainable in reserve and settable at a time after which the first packing element is set.

20 Claims, 3 Drawing Sheets

PACKER SYSTEM AND METHOD

BACKGROUND OF THE INVENTION

Slips and packing elements are devices commonly used in packer systems for downhole wellbore applications. Slips attach a tool string, or other tubular members, to a casing, a liner, an open hole or other structure of the wellbore so that the weight of the tubular member being anchored is not supported from the surface. Additionally, slips, by tying tubular members to downhole structures, allow other downhole tools in a tool string to be actuated in response to surface actions on the tool string such as pickup and setdown, for example. A tool that is commonly actuated after slips are set is a packing element.

Packing elements provide an annular seal between a tubular member and a structure of a wellbore, such as a casing, a liner, or an open hole of the wellbore, for example. Packing elements may be used to seal off a section of a well that is no longer productive, or a section of well that could flow unwanted fluids, such as water, into the production stream, for example. As such, the seal integrity of a packing element can have a significant affect on a well's viability. A leaking packing element can be costly for an operator in a number of ways. The leak itself is costly as it adversely affects production or affects the quality of the produced fluid(s). Moreover, since operators have an obligation to reduce money-wasting conditions when they are discovered a repair would be desirable. Repair generally requires that the packing element (and any associated components) be pulled from the well. Retrieval of the packing element to the surface for repair or replacement requires rig time, which is always costly. Add to the foregoing that the cost of repair or replacement of a packing element is generally not planned for as once a packing element is sealed in a wellbore it is intended to remain in place for a long time, possibly a number of years, and it becomes evident that packing element malfunction is clearly undesirable.

Unfortunately, the extreme environmental conditions that exist downhole can, over time, degrade packing elements resulting in the need to replace the packer. Because replacement of the packer requires significant rig time, it is expensive and therefore undesirable.

BRIEF DESCRIPTION OF THE INVENTION

Disclosed herein is a packer system. The packer system includes, a first packing element settable to create a seal against a downhole structure, and a contingency packing element in operable communication with the first packing element, maintainable in reserve and settable at a time after which the first packing element is set.

Further disclosed herein is a method for packing a borehole. The method includes, setting a slip assembly, setting a first packing element, and maintaining a contingency packing element in reserve.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of several embodiments of the disclosed apparatus and method are presented herein by way of exemplification and not limitation with reference to the Figures.

Figure 1:
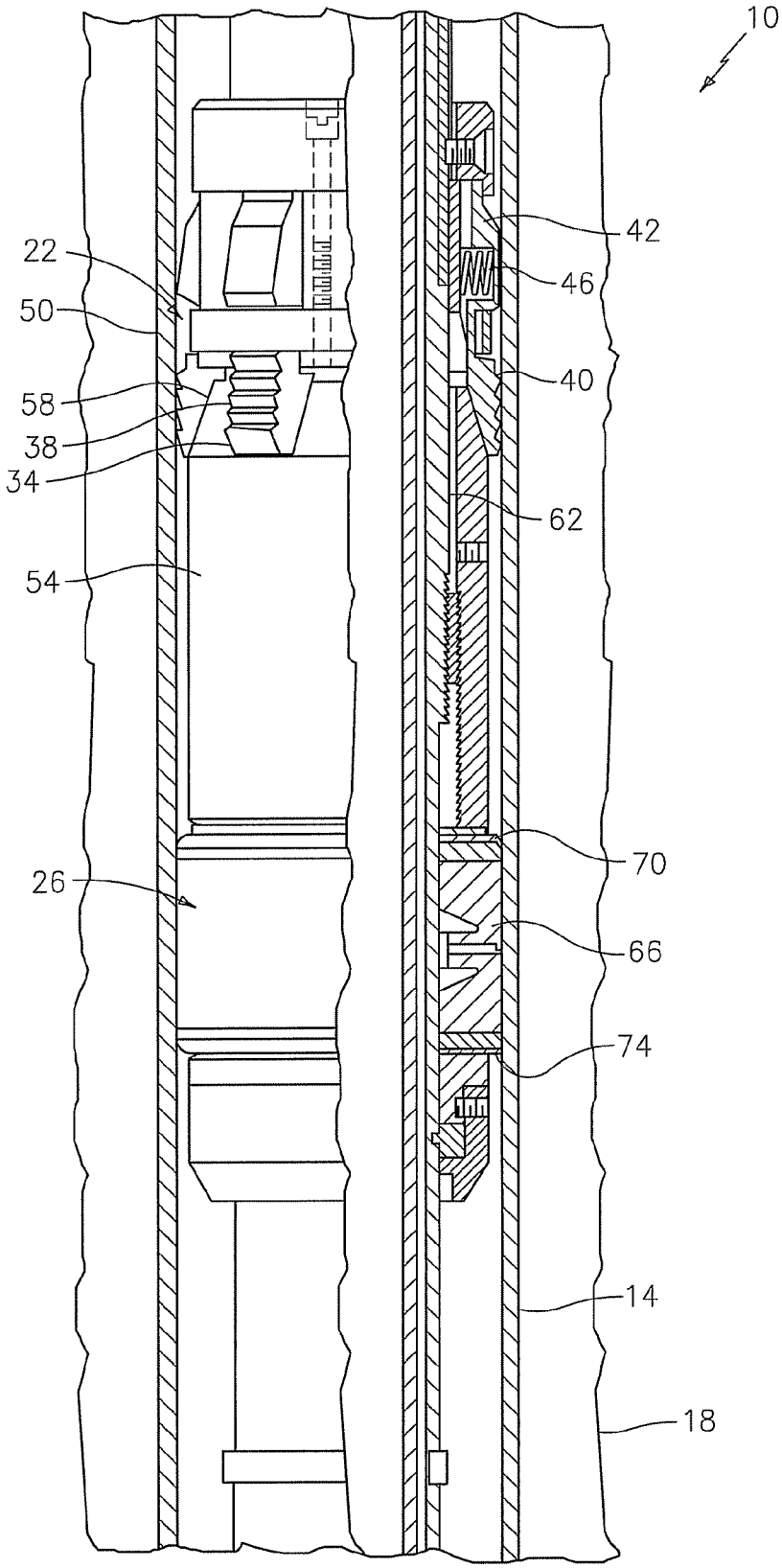
FIG. 1 depicts slips and a primary packing element of the packer system disclosed herein with both in actuated configurations.
Figure 2:
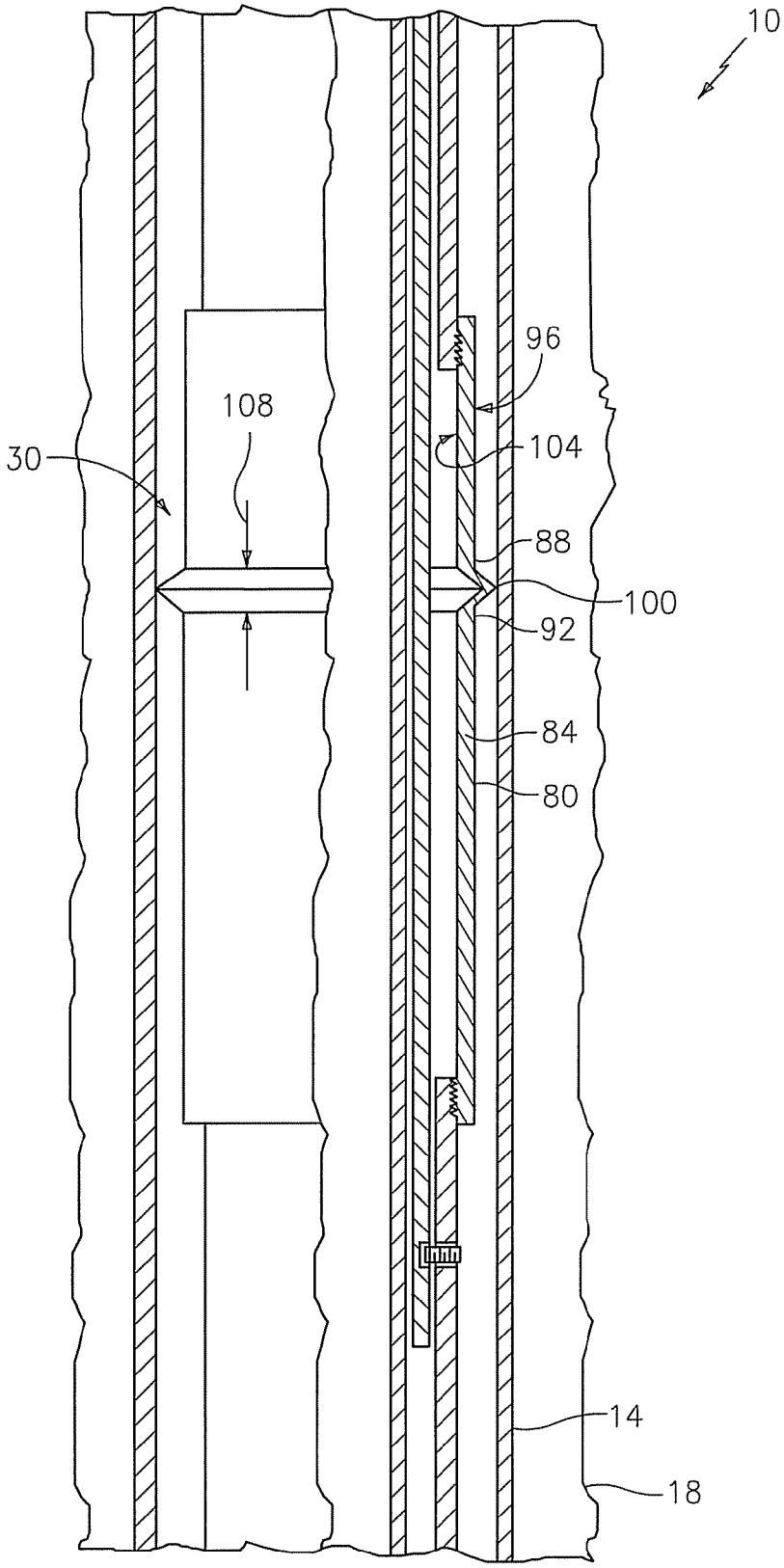
FIG. 2 depicts a contingency packing element of the packer system disclosed herein with the contingency packing element in an actuated configuration.

Referring to FIGS. 1 and 2 an embodiment of the packer system 10 is illustrated. The packer system 10 is shown positioned within a liner 14 that is positioned within a wellbore 18. The packer system 10 includes a primary packer 20, having a slip assembly 22 and a primary packing element 26, and a contingency packing element 30. The contingency packing element 30 (FIG. 2) disclosed herein is downhole of the slip assembly 22 and the primary packing element 26, however, it could just as well be located uphole of the slip assembly 22 and the primary packing element 26 depending upon a particular application and actuation mechanisms employed.

The slip assembly 22 illustrated in an embodiment in FIG. 1 is actuated and is therefore engaged with the liner 14 to maintain a position of the slip assembly 22, the packing elements 26, 30 and various tubular members connected thereto to the liner 14. It should be noted that in alternate embodiments the slip assembly 22 could be engaged directly to the open hole 18, a casing or other downhole structure. The slip assembly 22 can be set by any suitable conventional method and each slip assembly 22 includes a plurality of slips 34 each of which has a plurality of teeth 38 on a downhole portion 40 that bite into and frictionally engage with the liner 14 to thereby prevent relative movement of the slips 34 with the liner 14. An uphole portion 42 of the slips 34 are urged radially outwardly by springs 46 against a band 50 to maintain the slips 34 in a nonactuated configuration to avoid contact of the teeth 38 with the liner 14 until such actuation is desired. When actuation of the slip assembly 22 is desired a tubular member 54 with a frustoconical section 58 is urged in an uphole direction relative to the slips 34. Engagement of the frustoconical section 58 with the slips 34 causes the downhole portion 40 to ramp radially outwardly toggling the slips 34 such that the uphole portions 42 move radially inwardly compressing the springs 46 in the process. As the teeth 38 engage with the liner 14, locking the slips 34 to the liner 14, the frustoconical section 58 becomes wedged between the downhole portion 40 and a tubular body 62.

The primary packing element 26 is in operable communication with the slip assembly 22 such that, after the slip assembly 22 is engaged with the liner 14 actuation of the primary packing element 26 can be initiated. The primary packing element 26, illustrated in an actuated configuration in FIG. 1, includes a primary seal element 66 that sealably engages with the liner 14. Although seal element 66 disclosed herein is elastomeric, metal seal elements, such as is disclosed with reference to FIG. 2 below, could also be employed as the primary packing element 26. It should be noted that the primary packing element 26 could sealably engage with other downhole structures such as a casing or the open hole 18 of the wellbore, for example. The seal element 66 is axially compressed between a first ring 70 and a second ring 74. Axial compression of the seal element 66 between the rings 70 and 74 results in the outer diametrical dimension of the seal element 66 increasing until it sealably engages with the liner 14. When the primary packing element 26 is not actuated the rings 70, 74 are spaced axially apart such that the seal element 66 is not compressed and the outer dimension of the seal element 66 is substantially less than the inner dimension of the liner 14 and as such the seal element 66 is axially movable within the liner 14.

Actuation of the primary packing element 26 is effected by movement of the rings 70 and 74 towards one another. A variety of actuation mechanisms are known and can be controlled in a variety of ways to cause the movement of the rings 70 and 74 towards one another. For example, surface actions on the tool string such as, pickup and setdown. Such actuation methods are possible and cost effective while the tool string is still connected to surface prior to completion. Other mechanisms such as a hydraulic piston arrangements or an electric motor actuator, for example, can also be employed to actuate the tubular member 54 to initiate the actuation of the slip assembly 22. Examples of communication methods from surface to initiate actuation without a rig being in place will be described with reference to FIG. 2.

Failure of a primary packing element 26, resulting in leakage, within a well bore is not uncommon. Downhole conditions of high temperature and high pressure combined with the caustic nature of some downhole fluids can cause sealing materials to deteriorate over time and develop leaks. Elastomeric materials in particular, though excellent for initial sealability especially with imperfect surfaces, tend to degrade in the harsh environment and to develop leaks. After a leak develops removal from the wellbore to repair or replace the leaking packing element 26 can be time consuming and costly. As such, providing the contingency packing element 30 in a tool string for selective actuation, at a later time, should the need arise, may be economically advantageous for a well operator.

Additionally, placing one or more contingency packing elements 30 along a tool string may be desirable for reasons other than damage of the primary packing element 26. For example, it may become desirable to change the performance of a well by using the contingency packing element 30 to shut off a section of the well that has begun producing water. Alternately, the contingency packing element 30 or a plurality of the contingency packing elements 30 could be employed to convert a producing well into an injection well.

The contingency packing element 30, illustrated in FIG. 2, includes a metal tubular member 80 that can sealably engage with the liner 14. It should be noted that the contingency packing element 30 could also sealably engage with other downhole structures such as a casing or the open hole 18 of the wellbore, for example. The metal tubular member 80 comprises a generally hollow cylindrical body defining a member wall 84. The wall 84 has a plurality of circumferential lines of weakness therein spaced apart along a main axis of the tubular member 80. In one embodiment, a first line of weakness 88 and a second line of weakness 92 are provided in an outer surface 96 of the wall 84. A third line of weakness 100 is provided on an inner surface 104 of the wall 84. The third line of weakness 100 is positioned axially between the first line of weakness 88 and the second line of weakness 92. The first line of weakness 88 and the second line of weakness 92 define a deformation zone 108. The tubular member 80 deforms in response to an axial force being applied in a direction transverse to the tubular member's main axis. The direction of the deformation is determined by the location of the lines of weakness 88, 92 and 100. In the embodiment just described, the deformation will be radially outwardly. If the lines of weakness were reversed in position, for example, the deformation would be radially inwardly. In one embodiment, illustrated in FIGS. 2 and 3, the lines of weakness 88, 92 and 100 are defined by grooves in the surfaces 96 and 104. Particularly the first line of weakness 88 and the second line of weakness 92 are defined in this embodiment by diametrical grooves (FIG. 3) formed in the outer surface 96 of the wall 84, and the third line of weakness 100 is defined by a diametrical groove formed in the inner surface 104 of the wall 84.

The three lines of weakness 88, 92 and 100 each encourage local deformation of the tubular member 80 in a radial direction that tends to cause the groove to close. It will be appreciated that in embodiments where the line of weakness is defined by other than a groove, the radial direction of movement will be the same but since there is no groove, there is no "close of the groove". Rather, in such an embodiment, the material that defines a line of weakness will flow or otherwise allow radial movement in the direction indicated. The three lines of weakness 88, 92, 100 together encourage deformation of the tubular member 80 in a manner that creates a feature such as the contingency packing element 30. The feature is created, then, upon the application of an axially directed mechanical compression of the tubular member 80 such that the contingency packing element 30 is formed as the tubular member 80 is compressed to a shorter overall length. It should be appreciated, that alternate embodiments could locate differing numbers of lines of weakness on differing surfaces than those disclosed in embodiments herein while still achieving the deformation necessary to create a sealable contingency packing element 30. Although in the foregoing embodiment the contingency packing element 30 is made of metal it should be understood that alternate embodiments could have a contingency packing element with an elastomeric seal element.

A variety of actuation mechanisms to actuate the contingency packing element 30 can be controlled in a variety of ways. Unlike the primary packer 20, however, it may be advantages to initiate and actuate the contingency packing element 30 without the use of a rig at surface since the cost and lost production time required to set up a rig and run a line downhole would be very costly. The following embodiments are therefore available that do not require resetting of a rig and running of a new line downhole. Pressure pulse telemetry, in which pressure pulses are transmitted down a fluid column in a tubing or annulus from a surface unit can be received by an electronics module on the packer system 10 or other portion of a downhole tool string. The electronics module detects the pressure pulses and when a pre-programmed pattern of pulses is detected, triggers a setting tool, such as a hydrostatic setting tool, for example, that actuates the contingency packing element 30. A similar system could have an electronics module detect a chemical that is pumped downhole and initiate setting of the contingency packing element 30 upon receipt of the chemical pumped. Another actuation mechanism that can be employed uses an increase in pressure through a dedicated hydraulic line to rupture a rupture disc. Once ruptured a pressure differential between wellbore pressure and atmospheric pressure in a chamber can provide a driving force capable of setting the contingency pacing element 30. Other actuation mechanism embodiments can include a dedicated electrical control line, for example, that communicates to an electric motor driven actuation device. Regardless of the actuation mechanism used to actuate the contingency packing element 30 it may be desirable to have the contingency packing element 30 in operable communication with the primary slip assembly 22 such that the slip assembly 22 maintains the position of the packer system 10 within the wellbore during actuation of the contingency packing element 30. Having the contingency packing element 30 exposed to the downhole environmental conditions can detrimentally affect the contingency packing element 30 and, therefore, sealably protecting the contingency packing element 30 prior to its actuation may be desirable.

Figure 3:
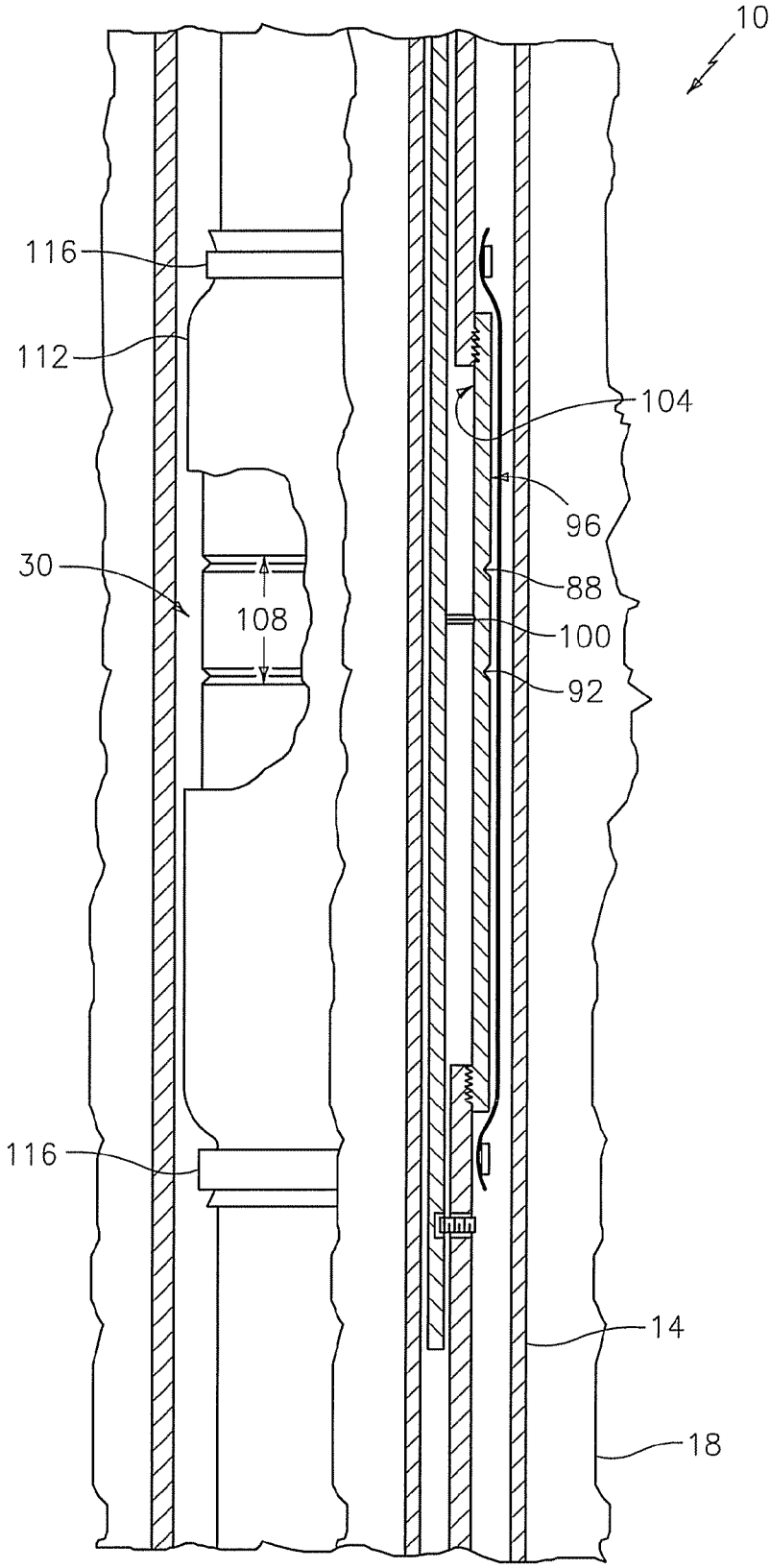
FIG. 3 depicts the contingency packing element of FIG. 2 in a nonactuated configuration.

Optionally, an annular sleeve 112 such as that shown in FIG. 3 can protect the contingency packing element 30 from the harsh environment until the contingency packing element 30 is actuated. The annular sleeve 112 can be any rupturable material, such as elastomeric, polymeric or even a thin sleeve of metal, for example. The annular sleeve can be sealably attached to the contingency packer system 10 by clamps 116, or other attachment devices at locations both uphole and downhole of the contingency packing element 30. In so doing, the contingency packing element 30 is sealably enclosed by the sleeve 112 and thereby isolated from direct contact with fluids in the wellbore that could potentially corrode or abrade the contingency packing element 30. Depending upon the structural properties of the sleeve 112 the sleeve 112 can be ruptured, for example, by the radial expansion of the packing element 30 during actuation of the packing element 30. Alternately, the sleeve 112 can be cut by the radial expansion force of the packing element 30 against the inner surface 104 of the tubular member 80.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A packer system comprising:

a first packing element settable to create a seal against a downhole structure;

a contingency packing element in operable communication with the first packing element, maintainable in reserve and settable through deformation of a deformable portion at a time after which the first packing element is set; and a protector in operable communication with the contingency packing element configured to protect at least the deformable portion of the contingency packing element from a downhole environment prior to deformation thereof.

2. The packer system as claimed in claim 1 wherein the first packing element is elastomeric.

3. The packer system as claimed in claim 1 wherein the first packing element is metal.

4. The packer system as claimed in claim 1 wherein the contingency packing element is constructed of metal.

5. The packer system as claimed in claim 4 wherein the contingency packing element comprises a generally hollow cylindrical body defining a member wall of the deformable portion, the wall having at least three circumferential lines of weakness therein, said lines of weakness being spaced along a main axis of the body, two of said lines of weakness being provided in one of an inner and outer surface of the wall and the other one of said lines of weakness being provided in the other one of said inner and outer surfaces of the wall, the axially outermost lines of weakness defining a zone of deformation of the body, wherein the deformable portion is deformable in the deformation zone in response to an applied force, in a direction transverse to said body main axis, said direction determined by the location of the other one of said lines of weakness in the wall.

6. The packer system as claimed in claim 1 wherein the contingency packing element is settable in an open hole.

7. The packer system as claimed in claim 1 wherein the contingency packing element is settable in a tubular.

8. The packer system as claimed in claim 1 wherein the protector is an annular protector.

9. The packer system as claimed in claim 8 wherein the protector is elastomeric.

10. The packer system as claimed in claim 8 wherein the protector is frangible.

11. The packer system as claimed in claim 1 wherein the contingency packing element is set in response to damage of the first packing element.

12. The packer system as claimed in claim 1 wherein the contingency packer is deformable mechanically.

13. The packer system as claimed in claim 1 wherein the contingency packing element is elastomeric.

14. The packer system as claimed in claim 1 wherein the protector includes a sleeve sealably engaged with the packer system at locations longitudinally beyond the deformable portion in two opposing directions.

15. A method for packing a borehole comprising:

setting a slip assembly;

setting a first packing element;

maintaining a contingency packing element having a deformable portion in reserve; and protecting the deformable portion of the contingency packing element prior to deformation thereof.

16. The method of claim 15 further comprising setting the contingency packing element upon a loss of performance of the first packing element.

17. The method of claim 15 further comprising setting the contingency packing element to affect a change in the purpose for which the well is being operated.

18. The method of claim 15 further comprising setting the contingency packing element in response to an occurrence of a selected event.

19. The method of claim 18 wherein the selected event is an undesirable event.

20. The method of claim 15 wherein the protecting includes sealably enclosing the deformable portion of the contingency packing element.

* * * * *